United States Patent [19]

Gray

[11] Patent Number: 4,905,743

[45] Date of Patent: Mar. 6, 1990

[54] FAUCET FOR FILLING MAPLE SYRUP JUGS AND THE LIKE

[76] Inventor: Alden J. Gray, P.O. Box 51, Ashfield, Mass. 01330

[21] Appl. No.: 271,212

[22] Filed: Nov. 14, 1988

[51] Int. Cl.[4] ..... B65B 3/26; B65B 3/30

[52] U.S. Cl. ..... 141/198; 141/95; 141/192; 141/360; 141/367; 73/294; 73/304 R; 340/620

[58] Field of Search ..... 141/94–96, 141/192, 198, 360–362, 367, 83; 340/620; 73/294, 304 R, 304 C

[56] References Cited

U.S. PATENT DOCUMENTS

| | | | |
|---|---|---|---|
| 2,639,078 | 5/1953 | Karlen | 141/95 X |
| 3,916,963 | 11/1975 | McIntosh | 141/198 |
| 4,236,553 | 12/1980 | Retchenberger | 141/198 |
| 4,258,758 | 3/1981 | Mygards | 141/35 |
| 4,437,497 | 3/1984 | Enander | 141/1 |
| 4,446,896 | 5/1984 | Campagna | 141/198 |
| 4,503,994 | 3/1985 | Pyle | 141/198 X |
| 4,530,384 | 7/1985 | Boyes | 141/95 |
| 4,641,692 | 2/1987 | Bennett | 141/95 |
| 4,712,591 | 12/1987 | McCann et al. | 141/198 X |
| 4,738,285 | 4/1988 | Belland | 141/1 |
| 4,753,277 | 6/1988 | Holcomb et al. | 141/95 |
| 4,787,427 | 11/1980 | Bacroix et al. | 141/39 X |

FOREIGN PATENT DOCUMENTS

| | | | |
|---|---|---|---|
| 0112002 | 6/1984 | European Pat. Off. | 141/95 |
| 2109557 | 6/1983 | United Kingdom | 141/95 |

OTHER PUBLICATIONS

Leader Evaporator Co., Inc., 1988 catalog.

*Primary Examiner*—Ernest G. Cusick

[57] ABSTRACT

A valve and coacting control circuitry for filling variously sized and shaped receptacles to an exact settable level with a relatively high impedance fluid such as maple syrup. Errors caused by bubbles are avoided by controlling the flow rate through a shaped orifice for essentially laminar flow. Dripping is eliminated by shaping the exit orifice to prevent gravitational emptying of the faucet cavity when the valve is closed. Sensing of the fluid is accomplished with a flexible wire probe, not sensitive to the receptacle shape but may be adjusted to a desired height, connected to a sensitive electronic circuit with a very high input impedance which allows sensing a voltage through the high impedance fluid. Once started, the filling process need not be monitored by an operator who is then free to do other tasks.

6 Claims, 2 Drawing Sheets

FAUCET FOR FILLING MAPLE SYRUP JUGS AND THE LIKE

BACKGROUND OF THE INVENTION

This invention relates to a faucet device for channeling fluid into a container and then stopping the flow of fluid when the fluid in the container has reached the desired level. The faucet is intended for use by maple syrup or fresh apple cider producers in their short seasonal operations to fill a variety of containers for market.

Most of these producers are individuals or families working in "sugar-shacks" with limited electrical power, and the process of filling jars or jugs is done manually often with frequent interruptions for other work or for conversing with customers. Problems with being distracted just as the faucet should be shut off are numerous. Other than losing valuable product, overfilling maple syrup cans is a serious problem because of the difficulty of cleaning the can for sale. Underfilling, besides upsetting customers, can lead to spoilage of the product due to air in the jug.

Because hot maple syrup tends to make bubbles during a filling operation, flow rates are usually set for slow filling. An essentially laminar flow reduces the foaming and allows the jug to be filled exactly full in one operation.

PRIOR ART

Distributors to the maple industry presently have three bottle fillers available. The first is the manual open / manual close faucet which is most common and has been used since the dark ages. The second type uses an overflow tube to siphon off syrup when the receptacle is full. This requires an overflow catch bucket which must be emptied, and since a tube must extend into the can being filled, most cans have to be "topped-off" after the filler is removed. The filler tube also has a tendency to drip after removal from the jug. If the operator is distracted too long while the jugs are filling, the entire supply tank can be dumped into the catch bucket.

A third type has a tube leading to a hand control which is used to seal the top of the container. When the operator sees fluid in a vent pipe on the hand control, he stops the flow by closing the valve in the hand control. This process requires the constant attention of the operator in maintaining the bung seal.

Automatic shutoff methods which may be learned from prior patents and available literature include dosing from an intermediary tank which limits ease of changing receptacle sizes, a mechanical float which would require space in a receptacle and need a large opening in the can, ultrasonic and infrared sensors which would be power hungry and technically beyond many producers, capacitive probes which would require ac power or conversion, and balanced platforms for the receptacle and weighting means which both sense an amount of fluid in the container not a correct level. Electrical impedance liquid and moisture sensors are available, but they all have at least two wires included in the sensor that extends into the neck of the receptacle and are not responsive to flow stoppage through the valve thereby creating a constant power drain until the full receptacle is removed. The present invention uses the fluid flowing into the receptacle as a conductor so that when the valve is closed, the circuit driving the solenoid is open by virtue of the discontinuity of the fluid path.

It is an object of this invention to provide a faucet that will automatically shut-off when the level of the fluid in the receptacle is exactly as desired.

It is another object of this invention to make an energy efficient controller that can operate from commonly available batteries without needing frequent recharges.

It is also an object of this invention to make a device that is easily understood and adjustable and maintainable by workers who commonly fill maple syrup or cider jugs.

The above said objects, the objects of overcoming the problems of prior art set forth above, and further objects and advantages of the present invention will appear more clearly from the following specification in connection with the accompanying drawings.

BRIEF SUMMARY OF MY INVENTION:

One faucet developed and tested is made from a commercially available self-closing barrel faucet to which is added a second actuating lever that can be latched in several positions. When the main lever is pushed, the added lever moves a rack over a pawl. A solenoid is positioned to raise the pawl allowing the original faucet's spring to close the valve. The whole mechanism is small, and including a gelled electrolite battery fits neatly in a plastic cover on top of the faucet.

The probe sensor is held in place with a slice from a bar of Ultra High Molecular Weight Polyethylene drilled to hold the probe and to fit over a flow shaping nozzle on the faucet. The probe itself is a short copper tube with an internal teflon insulating sleeve and very finely stranded wire. The combination allows a jug to be slid under the probe without requiring the probe to be moved or repositioned. The wire and insulation simply move and bend enough to allow the jug movement and then spring back to the set position. The copper slides in the UHMW easily enough to allow positioning the height of the probe for any size container placed closely under the nozzle.

The circuit used is a single stage MOSFET driver. Its very high input impedance allows fluid contact to be sensed even through a long distance of a high impedance fluid such as maple syrup. A resistor and parallel capacitor keep the circuit from giving false closings by being operated with static electricity.

To operate the faucet, a jug is first placed under the nozzle and the probe set if not already in position. The faucet is opened to a satisfactory flow rate. The operator is now free to tend to boiling sap, pressing cider, answering customer questions, or any other thing desired. When the syrup or cider in the jug rises to a level that touches the probe, the solenoid is activated allowing the faucet to close. Closing the faucet breaks the continuity of the fluid and stops the electricity flowing to the jug, and the solenoid stops using power.

The jug can then be slid out easily and capped. The very small volume of the probe will not leave a space that needs to be topped.

Another faucet built to the teachings of the present invention uses a solenoid valve and a separate ball valve to set flow rate. With this, the flow rate is set just once, and the valve is latched open electromagnetically. Operation requires placing the jug and pressing a button to start the flow. Again when the jug is full, power is off due to the stopped flow, and wait time does not pull on the battery.

DESCRIPTION OF AN EMBODIMENT FROM THE DRAWINGS

Figure 1:
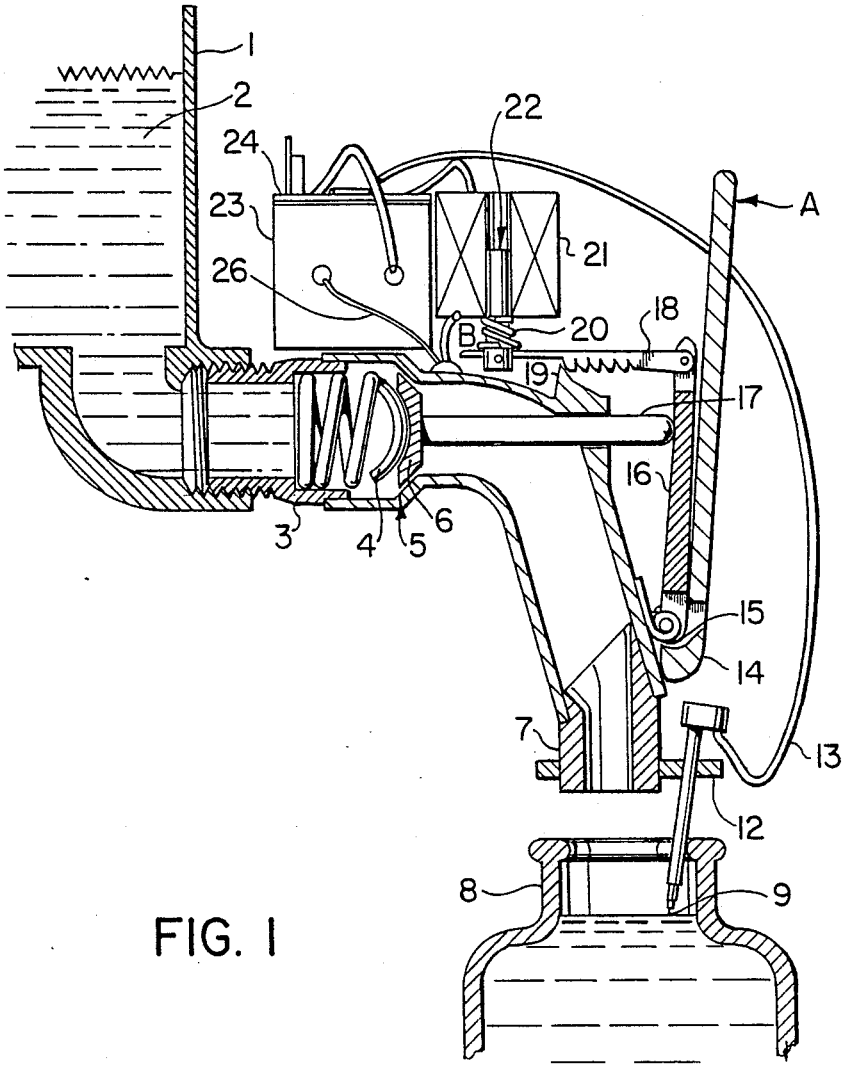
FIG. 1 is a sectional view of an exemplary faucet together with partial views representing a supply tank and a receptacle.

In FIG. 1 a sectional view is shown of an apparatus embodying the invention. The supply tank 1 has a supply of fluid 2 that is piped to a faucet 3. When a hand force is applied at A on lever 14, lever 14 contacts lever 16 which in turn contacts the pusher rod 17. Pusher rod 17 works against a bracing spring 4 to move the stopper 6 from its seat 5 thereby opening the faucet.

As the lever 16 is moved, co-acting rack is moved across the pawl 19 and held against the pawl 19 by the action of the spring 20. When the force at A is removed, the pawl 19 holds rack 18 and its connected members 16 and 17 which hold the faucet open. Lever 14 being acted on by spring 15 returns to a position where the lower extension of lever 14 is stopped by the body of the faucet 3. The purpose of having lever 14 return at the release of force A is to avoid its being impacted when the faucet springs closed.

With the faucet 3 open by virtue of stopper 6 having been moved away from its seat 5, fluid 2 flows to the receptacle 8 through the nozzle 7. The smoothly shaped and reduced inside diameter of said nozzle 7 acts in combination with the flow orifice between stopper 6 and seat 5 to provide essentially laminar flow of the exiting fluid. The nozzle 7 also acts as an aide for mounting the probe holder 12. One terminal of the battery 23 connects electrically to a first end of lead 26. The second end of said lead 26 connects electrically to the faucet 3 at point B which by virtue of the faucet 3 being metal also electrically connects to the fluid 2 flowing through the faucet 3 to the receptacle 8. When enough fluid 2 has entered the receptacle 8 for the fluid 2 to touch the short portion of uninsulated wire comprising probe point 9, the wire in the probe point 9 conducts the said electricity from the battery 23 and the fluid path to the circuit card 24 through wire 13. The electricity causes circuit components on the card 24 to allow electric current to flow directly through the solenoid 21. Solenoid plunger 22 acts against the force of spring 20 and raises the rack 18 off the holding pawl 19 thereby allowing spring 4 to act to move the stopper 6 against seat 5 closing the faucet 3 and interrupting the fluid flow into the receptacle 8. When the fluid 2 is not continuous to the receptacle 8, the receptacle 8 is no longer charged with electricity, and circuitry on card 24 as well as the solenoid 21 will deactivate and draw no more power from the battery 23.

Figure 2:
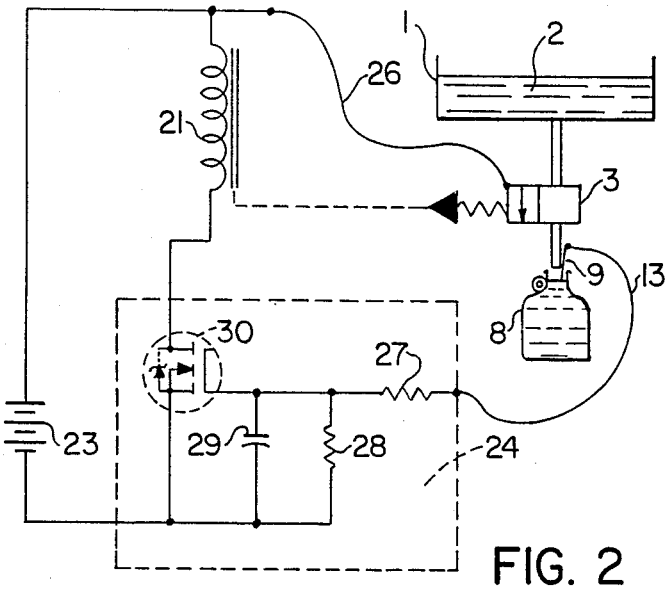
FIG. 2 is a schematic representation of the device and circuit as in FIG. 1.

FIG. 2 is a schematic of the system as described for FIG. 1. The faucet 3 is depicted as a normally closed, spring braced, manually operated valve with solenoid controlled latch. The additional features of a circuit as might be used include a high impedance resistor divider 27,28 and a small capacitor 29 to protect against static electricity. This occurs because the static voltage is dripped across resistor 27 while capacitor 29 is charging. The short duration of static will allow capacitor 29 to discharge through resistor 28 before the gate threshold voltage of transistor 30 is reached. The transistor 30, preferably a MOSFET transistor, provides a very high input impedance which means resistor 28 totally controls the current that must pass through the fluid contacting probe point 9 to charge capacitor 29 above the gate threshold of transistor 30. Selecting a high value for resistor 28 allows the circuit to sense voltage through a high impedance fluid such as maple syrup. When the charge voltage on capacitor 29 exceeds the gate threshold sufficiently, transistor 30 conducts and energizes the solenoid 21 closing the valve as described for FIG. 1.

Figure 3:
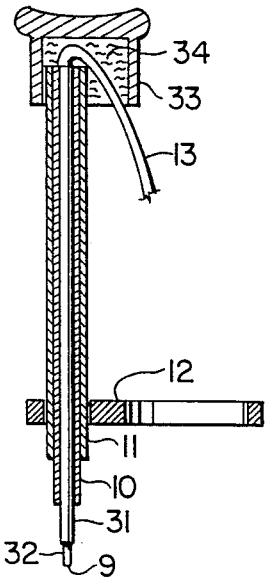
FIG. 3 shows more details of an exemplary probe arrangement as referenced in FIG. 1.

FIG. 3 is a sectional view of an arrangement for a probe as used in the faucet of FIG. 1. The probe consists of a hollow rigid member 11 slidably attached by passing through a close fitting hole in the probe holder 12. The hollow rigid member has internal sleeves of heat shrink tubing 10 and plastic tubing 31. Plastic coated wire 32, preferably using Teflon or other plastic coating with a low adhesive quality to avoid having a film of syrup on the surface, with only a few thousandths of an inch of uncoated wire extending for a probe point 9 provides an electrical signal path through the probe and connects to or is an extension of wire 13. A small plastic thumb cap 33 is placed over the end of the tube assembly and filled with a potting material 34 such as epoxy. The wire 13 connects to the circuit card 24 as in FIGS. 1 and 2.

Figure 4:
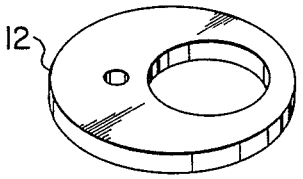
FIG. 4 shows a perspective view of a probe holder as referenced in the previous FIGS. 1 and 3.

FIG. 4 is a perspective of the probe holder 12 which is preferably made of a plastic material. The holes are sized to hold the part tightly in place on the nozzle 7 of FIG. 1 and more loosly and slidably hold the probe ridgid member 11 of FIG. 3.

I claim:

1. A device for filling an open variably shaped receptacle, with an opening, with fluid to a desired level, comprising:

a faucet connected operably to a supply tank of said fluid, said faucet internally designed to allow essentially laminar exit flow of said fluid, said faucet having a valve to control the flow of fluid through said faucet, a latch means with one or more steps operable to hold said valve open to one or more of a multiple of degrees compatible with a desired setting of laminar flow of said fluid, an electromagnetic solenoid operably connected to said latch means operable to release said latch means thereby closing said valve and stopping the flow of said fluid, a height adjustable probe means positionable in said variably shaped receptacle opening, an electrical source means having one pole electrically connected to said fluid supplied to said faucet and the other pole connected to said probe means, and a circuit means connected to be actuatable by said electrical source means when said probe means contacts the rising said fluid in said receptacle and operable to control said solenoid to release the latch means and thus close the valve.

2. A device for filling an open variably shaped receptacle with fluid to a desired level, as defined in claim 1, wherein said probe means is comprises of:

a hollow rigid member, a very flexible section of fine insulated stranded wire electrically connected to one end of said circuit means and which passes through and is mechanically connected to said rigid member but is electrically insulated from said rigid member, said section of fine insulated stranded wire extended amply beyond said rigid member and uninsulated only at an extremity of the other end.

3. The device as claimed in claim 2, where said fluid is maple syrup or other relatively high impedance fluid and wherein said circuit means has a high input impedance operable to sense through said high impedance fluid but not falsely sense static electricity.

4. A device for filling a variably shaped open receptacle with fluid to a preset level, comprising:

a valve means connected operably between a fluid supply tank and said receptacle, operating means for said valve means, latch means for holding said valve means open, means for adjusting and restricting the flow rate of said fluid in combination with exit orifice shaping means to provide essentially laminar flow of said fluid at the exit orifice, source means to provide direct-current electrical energy, connecting means for applying said electrical energy to said fluid on a supply tank side of said valve means, sensing means responsive to said electrical energy applied to said fluid when said fluid reaches said preset level, and electrical circuit means operable for releasing said latch means in response to said sensing means' sensing electrical contact with said fluid and thereby closing the valve means.

5. The device as claimed in claim 4, where said fluid is maple syrup or other relatively high impedance fluid and wherein said circuit means has a high input impendance operable to sense through said high impedance fluid but not falsely sense static electricity.

6. A device for filling a variably shaped open receptacle with fluid to a desired level, as defined in claim 4, wherein said sensing means is comprised of:

a hollow rigid member, a semi-flexible section of fine insulated stranded wire electrically connected to one end of said circuit means and which passes through and is mechanically connected to said rigid member but is electrically insulated from said rigid member, said section of fine insulated stranded wire extended amply beyond said rigid member and uninsulated only at the extremity of the other end.

* * * * *